US005496981A

United States Patent [19]

Sorenson

[11] Patent Number: 5,496,981

[45] Date of Patent: Mar. 5, 1996

[54] ELECTRICAL SWITCH

[76] Inventor: Richard W. Sorenson, 6540 SE. Harbor Cir., Stuart, Fla. 34996

[21] Appl. No.: 278,385

[22] Filed: Jul. 21, 1994

[51] Int. Cl.[6] ..... H01H 9/00

[52] U.S. Cl. ..... 200/315; 200/553; 200/562

[58] Field of Search ..... 200/553, 557, 200/561, 562, 563, 315, 554, 555, 556, 339

[56] References Cited

U.S. PATENT DOCUMENTS

| | | | |
|---|---|---|---|
| 4,135,073 | 1/1979 | Kobayashi | 200/315 |
| 4,320,271 | 3/1982 | Munroe | 200/561 |
| 4,347,417 | 8/1982 | Sorenson | 200/315 |
| 4,418,254 | 11/1983 | Busby et al. | 200/339 |
| 5,239,143 | 8/1993 | Valenzona | 200/339 |

*Primary Examiner*—Henry J. Recla
*Assistant Examiner*—David J. Walczak
*Attorney, Agent, or Firm*—McCormick, Paulding & Huber

[57] ABSTRACT

A single pole electrical switch of relatively thin overall dimension has a rocker provided on an off center axis in the circuit breaker housing, which rocker is adapted to slide a moveable contact across the upper ends of the fixed contacts to achieve opening and closing of these contacts. The moveable contact in the off position is spaced from one of the end walls of the switch case housing to allow provision for a third fixed terminal in a stepped portion of the bottom wall. The upper end of this third terminal is located in close proximity to the rocker so as to afford electrical connection with a resistor or other component of the lamp circuitry provided in the rocker.

8 Claims, 2 Drawing Sheets

ELECTRICAL SWITCH

BACKGROUND OF THE INVENTION

1) Field of the Invention

The present invention relates to miniature electrical switches, and deals more specifically with a switch designed with a minimum number of component parts, and wherein the fixed contacts can be identical to one another while nevertheless providing for sliding movement of the moveable contact across the upper ends of these fixed contacts.

2) Description of the Prior Art

Miniature electrical rocker switches of the type designed to be fabricated from a minimum number of parts have been available for some time, see for example U.S. Pat. No. 4,347,417 issued in 1982 to the inventor herein. The switch described in the '417 patent includes a pivoted actuator or rocker having a depending portion that is received in an opening provided for it in the moveable contact. A spring is provided on this depending portion for engaging the moveable contact and causing that moveable contact to move across the upper ends of the fixed contacts. In this '417 switch configuration of the prior art, the fixed contacts configurations require that these parts be individually fabricated. That is, they cannot be fabricated of identical construction, leading to increased expense particularly in the illuminated version of such a switch.

Prior art rocker switches generally provide for the rocker to be pivotably mounted in the center of the switch case housing directly over the centered fixed contact so that equal angular travel is provided in each direction. Special purpose rocker switches have been proposed where the pivot is not provided in the center of the switch case, as for example in U.S. Pat. No. 4,562,318 issued to the inventor herein. However in the '318 rocker switch the offset pivot of the rocker is provided to harness the spring acting on the moveable contact as a means for returning the rocker and moveable contact to a switch off position. The center fixed terminal is not aligned with the rocker pivot axis in this '318 patent disclosure.

SUMMARY OF THE INVENTION

It is a general purpose and object of the present invention to provide a rocker switch that not only provides for a minimum number of component parts, but which will also accommodate a standard fixed contact or terminal for both the "center position" and for the other fixed contacts of such a miniature rocker switch. Another object of the invention is to permit use of the same standard fixed contact or terminal for illuminating a light in the rocker itself.

BRIEF DESCRIPTION OF THE DRAWING

A more complete understanding of the invention and its attendant advantages will be appreciated and understood by reference to the following detailed description when considered in conjunction with the following drawing figures.

DETAILED DESCRIPTION OF THE PREFERRED EMBODIMENT

Figure 1:
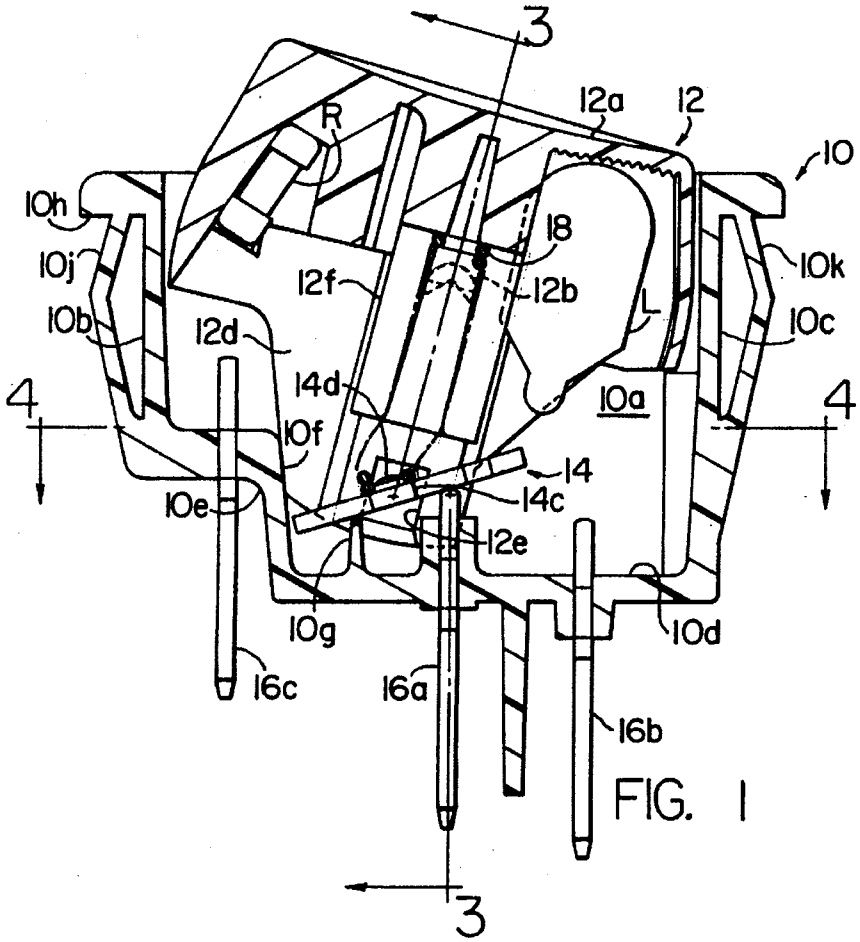
FIG. 1 is a vertical sectional view through a switch constructed in accordance with the present invention, and illustrates the rocker and associated moveable contact in the off position.

Turning now to the drawings in greater detail, FIG. 1 shows a switch case or housing 10 that defines an upwardly open cavity for receiving a rocker 12. The rocker 12 has sides or skirt portions **12*d* that define projecting axle defining portions that are received in aligned opening in the housing walls 10*a*. Thus the rocker 12 can be moved from the off position of FIG. 1 from and to the position shown for the rocker 12 in FIG. 2** (the on position).

The housing 10 is of molded one piece plastic with a front wall (not shown), a rear wall **10*a*, end walls 10*b* and 10*c*, and a bottom wall 10*d*. All of these walls are integrally connected to one another so as to form a generally rectangular configuration for the housing and to define a generally rectangular opening which provides access to the top surface 12*a* of the rocker 12** in order to facilitate movement of the switch from the on to the off position and from the off to the on position.

The rocker 12, like prior art rockers generally, is adapted to occupy the entire upwardly open cavity, and to pivot between these two positions for achieving the desired switching movement of the moveable contact 14. However, the rocker 12 differs from prior art rockers in that the pivot axis defined by the projecting axle portions **12*b* and 12*c* is not located in the precise center of the rocker 12 nor are the openings for receiving these projecting axle portions located midway between the end walls 10*b* and 10*c* of the housing 10. Instead, the housing 10 has a relieved lower corner portion 10*e* such that the bottom wall is stepped in order to define an inside surface 10*f* that serves as an abutment for the depending skirt portion 12*d* of the rocker 12. FIG. 1 shows the rocker 12 in the off position where this skirt portion 12*d* has engaged this abutment surface or wall 10*f* of the switch case 10**.

Figure 2:
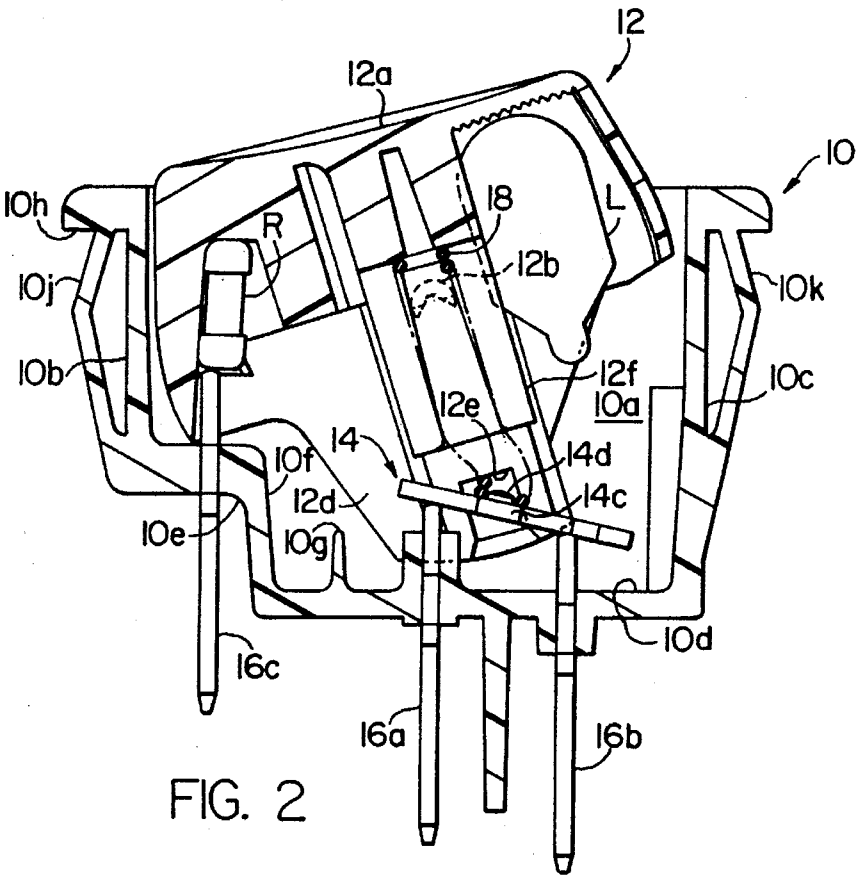
FIG. 2 is a view similar to FIG. 1 but illustrating the rocker and moveable contact in the switch on position.
Figure 5:
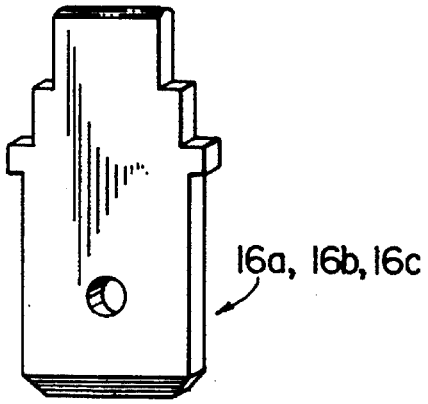
FIG. 5 is a perspective view of the common fixed contact or terminal as used in the switch of FIGS. 1–4 inclusively.

The abutment wall **10*f* of the switch case 10 reduces the interior volume of the housing 10 and restricts movement of the moveable contact 14. As shown in FIGS. 1 and 2, this problem is solved by providing a shortened moveable contact 14 that operates in the desired manner. Somewhat less travel for the moveable contact, and for the rocker 12 is provided for, at least for movement toward the on position (FIG. 2). Note that the right hand end of the rocker 12, associated with the end wall 10*c* does not move up as far as the other end of the rocker (FIG. 1). This non-symmetrical arrangement for the pivot axis of the rocker 12, and the associated movement of the moveable contact 14, allows the center fixed terminal 16*a* to be located directly under the rocker pivot axis. Thus, terminal 16*a* is closer to the end wall 10*c* than to the end wall 10*b* of the housing 10. This center fixed terminal 16*a* is provided with its upper end elevated inside the switch case cavity, that is, terminal 16*a* has its upper end above the upper end of the fixed terminal 16*b*. These terminals 16*a* and 16*b* are nevertheless identical in construction and configuration as best shown in FIG. 5. The bottom wall 10*d* of the switch case 10 defines an upstanding land 10*g* that serves to define the off position for the moveable contact 14. This land 10*g* is located at approximately the same height relative to center terminal 16*a* as is the upper end of the terminal 16*b***.

In the lighted version of the switch shown a third terminal 16*c* associated with a lamp circuit is provided in the relieved area 10*e* of the bottom wall and has its upper end spaced well above the inside surface of the bottom wall associated with the relieved area 10*e* of the switch case 10. More particularly, this terminal 16*c* has its upper end located well above both terminals 16*a* and 16*b*. Thus, terminal 16*c* is engaged by one end of a resistor R provided for this purpose in a receptacle defined in the underside of the rocker 12. FIG. 2 shows the resistor in engagement with the upper end of the fixed terminal 16*c* closing the lamp circuit in the switch on position such that the lamp L can be illuminated to indicate the condition of the switch.

Figure 3:
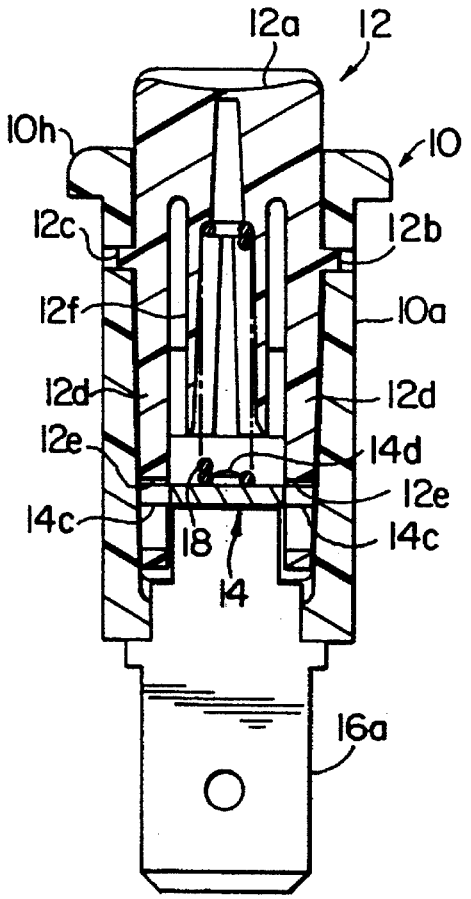
FIG. 3 is a sectional view taken generally on the line 3—3 of FIG. 1.
Figure 6:
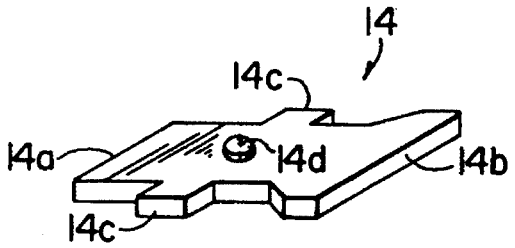
FIG. 6 is a perspective view of the moveable contact.
Figure 4:
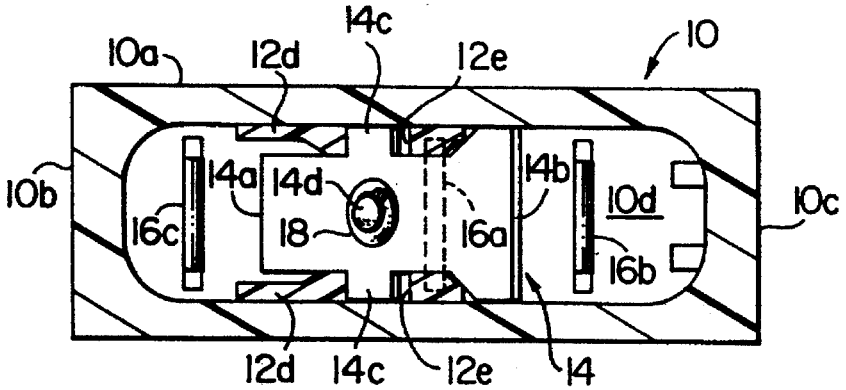
FIG. 4 is a horizontal sectional view taken generally on the line 4—4 of FIG. 1.

As best shown in FIG. 3 the spaced skirt portions 12*d* of the rocker 12 are provided with aligned slots 12*e* that are adapted to receive projecting ears defined for this purpose in a segment of the moveable contact 14 that is located closer to the left end of the moveable contact 14 than to the right end thereof. FIG. 6 shows the moveable contact 14 with the left end 14*a* provided closer to the ears 14*c*then is the opposite or right hand end 14*b*.

The moveable contact 14 also has a raised portion 14*d* provided on the pivot axis defined by the ears 14*c*which raised portion serves as a convenient anchor point for the lower end of a compression spring 18 that is provided with its opposite end in a depending post 12*f* in the rocker 12. The compression spring 18 is thereby restrained along a substantial portion of its length with only a short segment provided between the anchor point 14*d* of the rocker and the lower end of this depending post portion 12*f* of the rocker.

As so constructed and arranged the moveable contact 14 is free to float toward and away from the pivot axis of the rocker 12 as it moves between the position shown for it in FIGS. 1 and 2. This sliding action of the moveable contact 14 across the upper ends of the center fixed terminal 16*a* and the terminal 16*b* continuously burnishes these electrically conductive surfaces assuring a long life for the switch and avoids the arcing commonly found in switches of the type that simply pivot the moveable contact on a center fixed terminal without providing for any translation of the moveable contact as it pivots between its on and its off position.

The direct engagement between the compression spring and the moveable contact 14 is used to complete the lamp circuit associated with the terminal 16*c*, the resistor R, and the lamp as referred to previously. The lamp L has one lead electrically connected to the spring 18 and the other lead connected to resistor R.

The above described switch design provides for the first time a sliding moveable contact action in a rocker switch that provides for identical fixed terminals rather than requiring individually fabricated component parts for the terminals in such a rocker switch. Additionally, all the fixed terminals are of a flat metal configuration readily adapted to being stamped from a metal strip for example. So too the moveable contact 14 is readily fabricated from a metal strip in a stamping operation that contributes to the low cost of a switch constructed in accordance with the present design.

Assembly of the switch shown and described is also facilitated because it requires the handling of only one part versus three parts in a prior art switch of this type. This results in savings from a quality control and inventory aspect as well as savings in the distribution of the various component parts in a production line. The common configuration for the fixed terminals will also allow automation of the assembly line since only one supply source will be required for all three terminal components of the switch.

Another advantage to the switch design described herein can be traced to the relatively narrow or thin configuration of the terminals, particularly the moveable contact. As a result of the unique geometry between the compression spring, the moveable contact, and the center fixed terminal or contact a very thin or narrow switch can be provided with the result that less panel space need be occupied by a plurality of such switches in a particular installation. By reason of the narrow switch housing single wings can be integrally molded to the end walls 10*b* and 10*c* as indicated generally at 10*j* and 10*k* rather than double wings as in prior art switches. The relieved corner 10*e* of the switch housing comprises approximately one third the total switch depth behind the panel. Nevertheless, the wings 10*j* and 10*k* are nearly identical to one another. The switch is designed to be mounted from the front of a panel and has an integrally defined flange 10*h* around its upper portion for engaging the front face of the panel while these wings are deformed during the process of inserting the switch in a rectangular panel opening.

As a result of the offset pivot for the rocker 12 in the switch case housing 10 it will be apparent that the offset rocker will project further from the panel when the switch is in the off position than is true of the rocker in its on position. Such a feature is not a disadvantage however, and can be used to provide a ready indication of switch condition whether or not the rocker is illuminated.

I claim:

1. An electrical switch comprising:

an upwardly open housing of generally rectangular configuration with spaced front and rear walls that are integrally connected to one another by end walls and by a bottom wall to define a cavity, a rocker having skirt portions that define axle projections received in openings defined in said front and rear housing walls, said rocker being pivotable on a rocker pivot axis and said skirt portions being moveable between said housing front and rear walls and defining a space therebetween, a moveable contact having a segment provided in said space between said rocker skirt portions, said moveable contact having projecting ears at said moveable contact segment in said space defined by said skirt portions, said ears being received in slots provided in said skirt portions to allow limited movement of said movable contact toward and away from said pivot axis of said rocker and to allow rocking movement of said movable contact on a second axis defined by said ears, at least first and second contacts in said housing bottom wall with upper ends provided inside said housing, said fixed contacts provided in said bottom wall being of identical geometry, said first fixed contact having its upper end spaced above an upper end of said second fixed contact and a single compression spring having a substantial portion retained by said rocker between said skirt portions and having a free end portion engaging said moveable contact segment for urging said moveable contact toward said upper ends of said fixed contacts, whereby pivotal movement of said rocker causes said moveable contact to pivot and slide across said upper end of said first fixed contacts and to selectively make contact with said upper end of said second fixed contact.

2. The electrical switch according to claim 1 wherein said bottom wall includes a stepped portion to define an abutment surface inside said switch cavity that engages said rocker skirt portion and defines the off position for said rocker and its associated moveable contact.

3. The electrical switch according to claim 2 wherein said rocker pivot axis is closer to one end wail than to the other end wall.

4. The electrical switch according to claim 3 wherein said moveable contact is not symmetrical about the axis defined by said projecting ears, and wherein said moveable contact has an end most remote from said ear axis provided on the opposite side of said switch case housing as said other end wall thereof.

5. The electrical switch according to claim 3 wherein, a third fixed contact of identical geometry as said first and second contacts is provided in said switch case bottom wall, an upper end of said contact being provided higher than said upper end of said first contact, said third contact provided in said stepped bottom wall portion.

6. The electrical switch according to claim 3 wherein said bottom wall stepped portion is on the side most remote from said rocker pivot axis.

7. The electrical switch according to claim 2 wherein a third fixed terminal is provided in said stepped portion of said bottom wall, said third fixed terminal having an upper end spaced above the upper ends of said first and second fixed contacts, all of said fixed contacts being of identical geometry.

8. The electrical switch according to claim 2 wherein said rocker carries a lamp and lamp circuitry and and wherein a third fixed contact is provided in said stepped portion said rocker having a lamp circuit, and a portion of said lamp circuit engaged by said third fixed terminal upper end when said rocker is in an "on" position.

* * * * *